United States Patent [19]

Morrissey et al.

[11] Patent Number: 4,673,472

[45] Date of Patent: Jun. 16, 1987

[54] METHOD AND ELECTROPLATING SOLUTION FOR DEPOSITION OF PALLADIUM OR ALLOYS THEREOF

[75] Inventors: Ronald J. Morrissey, Cranston; Harry Kroll, East Greenwich, both of R.I.

[73] Assignee: Technic Inc., Providence, R.I.

[21] Appl. No.: 834,525

[22] Filed: Feb. 28, 1986

[51] Int. Cl.[4] ..... C25D 3/52

[52] U.S. Cl. ..... 204/44.6; 204/47; 423/351

[58] Field of Search ..... 204/44.6, 47; 423/351

[56] References Cited

U.S. PATENT DOCUMENTS 4,478,692 10/1984 Nobel ..... 204/44.6 X

FOREIGN PATENT DOCUMENTS 33178 8/1972 Japan ..... 204/44.6

*Primary Examiner*—G. L. Kaplan

*Attorney, Agent, or Firm*—Ostrolenk, Faber, Gerb & Soffen

[57] ABSTRACT

Electroplating solutions for the deposition of palladium or the alloys thereof, in which solutions palladium was added in the form of the reaction product of palladium diaminodinitrite with an acid in the presence of a scavenging agent for nitrous acid.

22 Claims, No Drawings

METHOD AND ELECTROPLATING SOLUTION FOR DEPOSITION OF PALLADIUM OR ALLOYS THEREOF

BACKGROUND OF THE INVENTION

In U.S. Pat. Nos. 4,278,514 and 4,406,755 are disclosed electroplating solutions for the deposition of palladium. Those solutions contain palladium in the form of a soluble organo-palladium complex formed from an inorganic palladium salt and an organic polyamine complexing agent. In the operation of those electroplating solutions, the organic polyamine remains free in the solution after the palladium has been electrodeposited. In the free state, the organic polyamine tends to increase stress in the electrodeposits. Accordingly, it is common operating practice to remove the polyamine as it is formed by circulating the solution through a filtering apparatus containing activated carbon. This has the disadvantage that activated carbon also removes a small amount of the usable organopalladium complex from the solution, and thus represents an additional cost.

A further characteristic of the electroplating solutions of U.S. Pat. Nos. 4,278,514 and 4,406,755 is that they are not easily adaptable to the electrodeposition of palladium alloy deposits. This is because the chemical stabilities of organometallic complexes formed from polyamines vary widely with the nature of the metal incorporated. In electrodepositing alloys, the discharge potentials of the metals to be co-deposited should be as close to each other in value as practicable. This is difficult or impossible if the chemical stabilities of the soluble metallic species present vary markedly from each other.

It is often desirable to produce alloys of palladium with other metals by electrodeposition. Wrought alloys of palladium with silver, for example, and both wrought and electrodeposited alloys of palladium with nickel have proven to be useful in electrical and electronic applications. Recently, B. Sturzenegger and J. Cl. Puippe: *Platinum Metal Rev.*, 28:117 (1984) reported the electrodeposition of alloys of palladium with silver using ammoniacal solutions and U. Cohen, K. R. Walton and R. Sard: *J. Electrochem. Soc.*, 131:2489 (1984) similarly described the use of acidic solutions containing large quantities of chloride ion to achieve the same purpose. U.S. Pat. Nos. 4,465,563 and 4,478,692 describe the electrodeposition of alloys of palladium with silver from solutions containing an excess of a strong organic or inorganic acid. In commercial practice, alloys of palladium with nickel are almost invariably electrodeposited from alkaline ammoniacal solutions, concerning which there exists a voluminous patent literature, both United States and foreign.

All of the solutions herein referred to for palladium alloy electrodeposition are, by virtue of excess acidity, alkalinity, or the presence of large concentrations of ammonium or chloride ions, chemically aggressive toward most base metals, i.e., nickel, copper, or copper alloys, onto which the desired palladium alloy electrodeposits are ordinarily applied. Consequently, the electroplating processes require that a strike, usually of gold, silver or palladium, be applied to the work in order to protect it from attack by the electroplating solution. Such a strike requirement represents both an additional cost and a loss of process freedom, as the presence of a strike coating dissimilar to both the base metal and the electrodeposit raises the possibilities of galvanic interaction in the event of electrodeposit porosity, or of interdiffusion at elevated temperatures. It is clearly desirable, then, that in any electroplating process, the electroplating solution should be as chemically nonaggressive as possible toward the work to be electroplated, so that the requirement for a strike deposit can be minimized or eliminated entirely.

In view of the foregoing, it is an object of this invention to provide an electroplating solution for the deposition of palladium, said solution being free of organic polyamine complexing agents.

It is a further object that the electroplating solution thus constituted should, upon addition of a suitable soluble species of an alloying metal, be capable of depositing an alloy of palladium with the said alloying metal.

It is a further object that the solution or solutions of this invention be capable of operating in a range of pH which is neither very strongly acid nor alkaline.

It is yet a further object that electrodeposits produced in accordance with this invention should be bright, and, to as great a degree as possible, free of such defects as porosity, cracking, and excessive stress.

SUMMARY OF THE INVENTION

This invention relates to palladium electroplating solutions and the use thereof, and particularly to aqueous solutions containing palladium in the form of a reaction product formed from palladium diaminodinitrite with an acid in the presence of a scavenging agent for nitrous acid; to which solutions various brightening agents and various soluble species of suitable alloying metals may be added for the purpose of obtaining bright palladium or palladium alloy electrodeposits.

DESCRIPTION OF THE INVENTION

When palladium in the form of the diaminodinitrite, $Pd(NH_3)_2(NO_2)_2$ is reacted with an acid HA (where A is used to represent a monovalent anion such as chloride, fluoborate, sulfamate, etc.), an equilibrium is established as follows:

$$Pd(NH_3)_2(NO_2)_2+2HA \rightleftharpoons Pd(NH_3)_2(A)_2+2HNO_2 \quad (I)$$

For the case of an acid $H_2A'$ in which the anion A' is divalent, as, e.g., sulfuric, the reaction is given by $$Pd(NH_3)_2(NO_2)_2+H_2A' \rightleftharpoons Pd(NH_3)_2A'+2HNO_2 \quad (II)$$

When the reactions (I) or (II) are performed in the presence of a scavenging agent for nitrous acid, such that nitrous acid can be removed from the system as it is formed, the production of the reaction product(s) $Pd(NH_3)_2(A)_2$ or $Pd(NH_3)_2A'$ can proceed to completion. Suitable scavenging agents for nitrous acid include ammonium salts in general, amides, urea, and sulfamic acid. The use of these latter scavenging agents may be illustrated as follows:

Urea, $H_2N—CO—NH_2$, reacts quantitatively with nitrous acid (R. Q. Brewster, *Organic Chemistry*, 2nd Ed., Prentice-Hall, New York, 1953, p. 249), liberating nitrogen, $CO_2$ and water according to $$H_2N—CO—NH_2+2HNO_2 \rightarrow 2N_2+CO_2+3H_2O \quad (III)$$

Thus, by reacting palladium diaminodinitrite with an acid in the presence of urea, it is possible to form a series of palladium compounds of the general formula $Pd(NH_3)_2(A)_2$ or $Pd(NH_3)_2A'$ in essentially quantitative yield. Generally acids of ionization constant Ka of $1\times10^{-3}$ or greater are suitable for this process. At least a stoichiometric amount, and preferably an excess, of the acid is used in forming the reaction product. Under these conditions, the reactions proceed readily at ambient temperatures and pressures.

Among readily available acids, sulfamic acid, $H_2N$—$SO_3H$, is unique in that in addition to functioning as an acid, it is itself a scavenging agent for nitrous acid (T. Moeller, *Inorganic Chemistry,* John Wiley, New York, 1952, p. 616), reacting as $$HNO_2+H_2NSO_3H\rightarrow N_2+H_2O+H_2SO_4 \quad (IV)$$

It is thus possible to form diamine palladium (II) disulfamate, $Pd(NH_3)_2(SO_3NH_2)_2$, either by reacting the diaminodinitrite with sulfamic acid in the presence of urea, or by reacting the diaminodinitrite with mixtures of ammonium sulfamate with sulfamic acid, or with sulfamic acid alone. We find that in actual practice, the reactions of palladium diaminodinitrite with sulfamic acid alone, or with mixtures of ammonium sulfamate with sulfamic acid result in mixtures of diamine palladium (II) disulfamate and diamine palladium (II) sulfate, $Pd(NH_3)_2SO_4$. Diamine palladium (II) disulfamate can be obtained in high yield by the addition of sulfamic acid to mixtures of palladium diaminodinitrite with urea as hereinabove described. Diamine palladium (II) sulfate can be formed similarly by the addition of sulfuric acid to mixtures of palladium diaminodinitrite with urea.

We find that ductile, crack-free palladium electrodeposits can be plated at high rates of speed and at current efficiencies approaching 100 percent from aqueous electroplating solutions containing reaction products formed from palladium diaminodinitrite with various acids in the presence of a scavenging agent for nitrite as hereinabove described, said electroplating solutions also containing certain nitrogen-bearing heterocyclic organic compounds, and operated at pH values from about 1.5 to 4.0, optimally from about 2.0 to 3.5. These solutions do not require or use an excess of strong acid.

The concentration of palladium can vary from about 1 to 30 grams per liter in the electroplating solutions of this invention, and may be higher, up to 50 or 75 grams per liter, in the replenishment concentrates which are added to the electroplating solutions.

We find further that if suitable soluble species of various alloying metals including, but not limited to, silver, nickel, ruthenium and platinum are added to palladium electroplating solutions of this invention, alloy deposits of palladium with the various alloying metals can be electroplated. To the best of our knowledge, the electrodeposition of palladium or of alloys of palladium from electroplating solutions as herein described had not previously been reported.

Various electrolytes are suitable for use in the palladium or palladium alloy electroplating solutions of this invention. For the purpose of electrodepositing pure palladium, we find it useful to employ mixtures of lower molecular weight amino acids such as glycine, beta-alanine, dl-alanine or taurine with various acids. Such mixtures are of good electrical conductivity and are particularly advantageous in that they are well buffered in the pH range from about 1.5 to 4.0. The addition of various nitrogen-containing heterocyclic organic compounds such as succinimide, maleimide, pyridine, pyridine 3-sulfonic acid, 3-pyridine acetic acid, nicotinic acid, nicotinamide, nicotinyl alcohol, pyridinium ethyl sulfobetaine, pyridinium propyl sulfobetaine, pyridinium butyl sulfobetaine, piperidine, piperazine, and pyrazine, either singly or in combination to suitable electrolytes containing the various reaction products of palladium diaminodinitrite with acids as hereinabove described results in brightening of the electrodeposits and extension of the range of current densities over which bright electrodeposits are obtained.

For the purpose of electroplating alloy deposits of palladium with silver, buffered electrolytes incorporating amino acids as hereinabove described are suitable. Palladium is most advantageously added as the reaction product formed by palladium diaminodinitrite with sulfamic acid in the presence of urea, although the reaction product of palladium diaminodinitrite with sulfamic acid alone is likewise suitable. Silver is preferably added as the sulfamate, although the nitrate, carbonate, methane sulfonate, fluoborate, or a succinimide complex as described in U.S. Pat. Nos. 4,126,524 and 4,246,077 can be used. Addition of succinimide to the electrolyte in amounts from about 1–30 grams per liter assists in solubilizing silver and partially brightens the deposit. Further brightening of the deposit and stabilization of the solution is achieved by the addition of one or more sulfur-containing organic compounds such as thioglycolic acid, thiolactic acid, thiomalic acid, thiourea, imidazolidine thione, S-sulfopropyl thiourea, 2-mercaptobenzothiazole S-propyl sulfonate, potassium ethylxanthate, or potassium ethylxanthate S-propyl sulfonate. It is also possible to replenish silver in these electrolytes by the use of a soluble silver anode.

Nickel is strongly chelated by the lower molecular weight amino acids, so that for the purpose of electroplating alloy deposits of palladium with nickel, solutions of nonchelating simple salts are preferable as supporting electrolytes. Palladium may be added, variously, as the reaction product or products formed from palladium diaminodinitrite with hydrochloric, sulfuric, sulfamic, or fluoboric acids in the presence of urea; or as the reaction product of palladium diaminodinitrite with sulfamic acid alone. Nickel may be added, variously, as the carbonate, chloride, sulfate, sulfamate, or fluoborate. Brightening of the electrodeposits from these solutions may be achieved by adding to the solutions one or more nitrogen-containing heterocyclic organic compounds such as those hereinabove referred to as brightening agents for pure palladium electrodeposits. Alternatively, sulfur-containing organic compounds as exemplified by saccharin and its derivatives, or by sodium allyl sulfonate, are useful as brightening agents. These may be used either singly or in combination with each other or in combination with the nitrogen-containing heterocyclic organic compounds referred to above.

For the purpose of electroplating alloy deposits of palladium with ruthenium, buffered electrolytes incorporating amino acids are suitable. Palladium is most advantageously added as the reaction product formed from palladium diaminodinitrite with sulfamic acid in the presence of urea, although the reaction product formed from palladium diaminodinitrite with sulfamic acid alone is likewise suitable. Ruthenium may be added in the form of the nitrogen-bridged anionic complex $[Ru_2NCl_8(H_2O)_2]^{-3}$. Brightening of the electrodeposits from these solutions may be achieved by adding to the solution one or more nitrogen-containing heterocyclic organic compounds such as those hereinabove referred to as brightening agents for pure palladium electrodeposits.

For the purpose of electroplating alloy deposits of palladium with platinum, buffered electrolytes incorporating amino acids are suitable. Palladium may be added, variously, as the reaction product formed from palladium diaminodinitrite with hydrochloric, sulfuric or sulfamic acids in the presence of urea, or as the reaction product formed from palladium diaminodinitrite with sulfamic acid alone. Platinum may be advantageously added as an amino acid complex of a suitable soluble platinum (II) salt, such as diglycine platinum (II) chloride, or bis(beta-alanine) platinum (II) chloride. Brightening of the electrodeposits from these solutions may be achieved by adding to the solution one or more nitrogen-containing heterocyclic organic compounds such as those hereinabove referred to as brightening agents for pure palladium electrodeposits.

In order to illustrate the present invention, some examples may be given as follows:

EXAMPLE 1

Sufficient water was used to form one liter of a palladium electroplating solution containing the following:

8 grams palladium in the form of the reaction product of palladium diaminodinitrite with sulfamic acid
90 grams sulfamic acid
90 grams glycine The solution pH was adjusted to pH 2.5 with ammonium hydroxide. A test panel was plated from this solution in a Hull cell for two minutes at one ampere at 55° C. A semibright-to-bright deposit of palladium was obtained at current densities from near zero to about 12 mA/cm$^2$.

EXAMPLE 2

A palladium electroplating solution was made up as in Example 1, but additionally containing 15 grams of succinimide. A test panel was plated from this solution in a Hull cell for two minutes at one ampere at 55° C. A bright, crack-free deposit of palladium was obtained at current densities ranging from near zero to about 20 mA/cm$^2$.

EXAMPLE 3

A palladium electroplating solution was made up as in Example 2, except that in place of succinimide, 0.2 gram of pyridine 3-sulfonic acid was used. A test panel was plated from this solution in a Hull cell for two minutes at one ampere at 55° C. A brilliant crack-free deposit of palladium was obtained at current densities from near zero to about 30 mA/cm$^2$.

EXAMPLE 4

A palladium electroplating solution was made up as in Example 3, except that in place of glycine, 90 grams of dl-alanine was substituted. A test panel was plated from this solution in a Hull cell for two minutes at one ampere at 55° C. A brilliant crack-free deposit of palladium was obtained at current densities from near zero to about 30 mA/cm$^2$.

EXAMPLE 5

A palladium electroplating solution was made up as in Example 3, except that palladium was added in the form of the reaction product formed by palladium diaminodinitrite with sulfamic acid in the presence of urea. A test panel was plated from this solution in a Hull cell for two minutes at one ampere at 55° C. A brilliant crack-free deposit of palladium was obtained at current densities from near zero to about 40 mA/cm$^2$.

EXAMPLE 6

Sufficient water was used to form one liter of a palladium electroplating solution containing the following:

8 grams palladium in the form of the reaction product formed by palladium diaminodinitrite with sulfuric acid in the presence of urea
65 milliliters sulfuric acid, 96%
90 grams glycine
15 grams succinimide
0.1 gram pyridine 3-sulfonic acid The solution pH was approximately 2.5. A test panel was plated from this solution in a Hull cell for two minutes at one ampere at 55° C. A bright, crack-free deposit of palladium was obtained at current densities from near zero to about 20 mA/cm$^2$.

EXAMPLE 7

Sufficient water was used to form one liter of a palladium electroplating solution containing the following:

8 grams palladium in the form of the reaction product of palladium diaminodinitrite with methane sulfonic acid in the presence of urea
150 milliliters methane sulfonic acid, 70%
90 grams glycine
0.1 gram nicotinamide The solution pH was approximately 2.5. A test panel was plated from this solution in a Hull cell for two minutes at one ampere at 55° C. A bright, crack-free deposit of palladium was obtained at current densities from near zero to about 15 mA/cm$^2$.

EXAMPLE 8

Sufficient water was used to form one liter of an electroplating solution for alloy deposits of palladium with silver, as follows:

5 grams palladium in the form of the reaction product formed by palladium diaminodinitrite with sulfamic acid in the presence of urea
90 grams sulfamic acid
90 grams dl-alanine
15 grams succinimide
0.15 grams potassium ethylxanthate s-propyl sulfonate
0.15 grams p-phenolsulfonic acid, sodium salt
0.25 grams silver in the form of silver sulfamate The solution pH was adjusted to about 2.5 with ammonium hydroxide. A test panel was plated from this solution in a Hull cell for two minutes at one ampere at 55° C. A bright alloy deposit of palladium with about 10–20% silver was obtained at current densities from near zero to about 20 mA/cm$^2$.

EXAMPLE 9

Sufficient water was used to form one liter of an electroplating solution for alloy deposits of palladium with silver, as follows:

5 grams palladium in the form of the reaction product formed by palladium diaminodinitrite with sulfamic acid in the presence of urea
90 grams sulfamic acid
90 grams glycine
15 grams succinimide
0.025 grams 2-mercaptobenzothiazole s-propyl sulfonate
0.15 grams p-phenolsulfonic acid, sodium salt 0.25 grams silver in the form of silver sulfamate The solution pH was adjusted to about 2.5 with ammonium hydroxide. A test panel was plated from this solution in a Hull cell for two minutes at one ampere at 55° C. A bright alloy deposit of palladium with about 10–20% silver was obtained at current densities from near zero to about 20 mA/cm$^2$.

EXAMPLE 10

Sufficient water was used for form one liter of an electroplating solution for alloy deposits of palladium with nickel, as follows:

5 grams palladium in the form of the reaction product formed from palladium diaminodinitrite with fluoboric acid in the presence of urea
50 milliliters fluoboric acid, 48%
30 grams boric acid
30 milliliters ammonium hydroxide, 30%
5 grams nickel in the form of nickel fluoborate
0.15 grams pyridine 3-sulfonic acid The solution pH was adjusted to about 1.8. A test panel was plated from this solution in a Hull cell for two minutes at one ampere at 55° C. A bright alloy deposit of palladium with about 20% nickel was obtained at current densities from near zero to about 30 mA/cm$^2$.

EXAMPLE 11

Sufficient water was used to form one liter of an electroplating solution for alloy deposits of palladium with nickel, as follows:

5 grams palladium in the form of the reaction product of palladium diaminodinitrite with sulfamic acid in the presence of urea
90 grams sulfamic acid
60 milliliters ammonium hydroxide, 30%
5 grams nickel as nickel sulfamate
0.35 grams sodium saccharin
0.20 grams sodium allyl sulfonate The solution pH was adjusted to about 2.5 with ammonium hydroxide. A test panel was plated from this solution in a Hull cell for two minutes at one ampere at 55° C. A bright alloy deposit of palladium with about 30% nickel was obtained at current densities from near zero to about 25 mA/cm$^2$.

EXAMPLE 12

Sufficient water was used to form one liter of an electroplating solution for alloy deposits of palladium with ruthenium, as follows:

2.5 grams palladium in the form of the reaction product formed by palladium diaminodinitrite with sulfamic acid in the presence of urea
45 grams sulfamic acid
60 grams taurine
5.0 grams ruthenium in the form of $(NH_4)_3[Ru_2NCl_8(H_2O)_2]$
30 grams succinimide The solution pH was about 1.8. A test panel was plated from this solution in a Hull cell for two minutes at one ampere at 65° C. A semibright-to-bright alloy deposit of palladium with about 10% ruthenium was obtained at current densities from near zero to about 15 mA/cm$^2$.

EXAMPLE 13

Sufficient water was used to form one liter of an electroplating solution for alloy deposits of palladium with platinum, as follows:

5 grams palladium in the form of the reaction product formed by palladium diaminodinitrite with sulfamic acid in the presence of urea
45 grams sulfamic acid
45 grams glycine
15 grams succinimide
5 grams platinum in the form of diglycine platinum (II) chloride The solution pH was about 2.2. A test panel was plated from this solution in a Hull cell for two minutes at one ampere at 65° C. A semibright-to-bright deposit of palladium with about 20% platinum was obtained at current densities from near zero to about 10 mA/cm$^2$.

Although the present invention has been described in connection with preferred embodiments thereof, many variations will now become apparent to those skilled in the art. It is preferred, therefore, that the present invention be limited not by the specific disclosure, herein but only by the appended claims.

What is claimed is:

1. An electroplating solution for the deposition of palladium or of alloys thereof, having a pH between about 1.5 and 4.0, and containing palladium in the form of a reaction product formed from palladium diaminodinitrite with an acid in the presence of a scavenging agent for nitrite, said acid being selected from the group consisting of sulfamic, sulfuric, methane sulfonic, fluoroboric and nitric.

2. The electroplating solution of claim 1 containing palladium in the form of the reaction product of palladium diaminodinitrite with sulfamic acid.

3. The electroplating solution of claim 1 containing palladium in the form of the reaction product of palladium diaminodinitrite with sulfuric acid.

4. The electroplating solution of claim 1 containing at least one nitrogen-containing heterocyclic organic brightener whereby a bright electrodeposit can be obtained.

5. The electroplating solution of claim 4 wherein the nitrogen-containing heterocyclic organic brightener is selected from the group consisting of succinimide, maleimide, pyridine, pyridine 3-sulfonic acid, 3-pyridine acetic acid, nicotinic acid, nicotinamide, nicotinyl alcohol, pyridinium ethyl sulfobetaine, pyridinium propyl sulfobetaine, pyridinium butyl sulfobetaine, piperidine, piperazine, and pyrazine.

6. The electroplating solution of claim 1 containing a soluble compound of a palladium alloying metal selected from the group consisting of silver, nickel, ruthenium and platinum.

7. The electroplating solution of claim 6 wherein the soluble compound is silver sulfamate, silver nitrate, silver carbonate, silver methane sulfonate, silver fluoborate, or a silver disuccinimide complex.

8. The electroplating solution of claim 7 containing succinimide.

9. The electroplating solution of claim 7 containing at least one sulfur-containing compound selected from the group consisting of thioacetic acid, thioglycolic acid, thiolactic acid, thiomalic acid, thiourea, imidazolidine thione, s-sulfopropyl thiourea, 2-mercaptobenzothiazole, 2-mercaptobenzothiazole s-propyl sulfonate, potassium ethylxanthate, and potassium ethylxanthate s-propyl sulfonate.

10. The electroplating solution of claim 6 wherein the soluble compound is selected from the group consisting of nickel carbonate, nickel chloride, nickel sulfate, nickel sulfamate, and nickel fluoborate.

11. The electroplating solution of claim 10 containing at least one nitrogen-containing heterocyclic organic brightener whereby a bright electrodeposit can be obtained.

12. The electroplating solution of claim 10, containing at least one sulfur-containing organic compound selected from the group consisting of saccharin, the potassium, sodium and ammonium salts of saccharin, and the potassium, sodium and ammonium salts of allyl sulfonic acid.

13. The electroplating solution of claim 6 wherein the added soluble compound is a potassium, sodium or ammonium salt of the complex anion $[Ru_2NCl_8(H_2O)_2]^{-3}$.

14. The electroplating solution of claim 13 containing at least one nitrogen-containing heterocyclic organic brightener whereby a bright electrodeposit can be obtained.

15. The electroplating solution of claim 6 wherein the soluble compound is selected from the group consisting of diglycine platinum (II) chloride, bis(beta-alanine) platinum (II) chloride, and bis(dl-alanine) platinum (II) chloride.

16. The electroplating solution of claim 15 containing at least one nitrogen-containing heterocyclic organic brightener whereby a bright electrodeposit can be obtained.

17. The method of electroplating a palladium deposit on a substrate employing a palladium-containing electrolyte, the improvement which comprises said electrolyte containing palladium in the form of a reaction product formed from palladium diaminodinitrite with an acid selected from the group consisting of sulfamic, sulfuric, methane sulfonic, fluoroboric and nitric in the presence of a scavenging agent for nitrite, and said electrolyte having a pH of about 1.5 to 4.0.

18. The method of claim 17 wherein said pH is about 2 to 3.5.

19. The method of claim 17 wherein said electrolyte contains a soluble compound of a palladium-alloying metal.

20. The method of claim 19 wherein said palladium-alloying metal is silver, nickel, ruthenium of platinum.

21. The method of claim 17 wherein said scavenging agent is urea.

22. The method of claim 17 wherein said scavenging agent is urea and said acid is sulfamic acid.

* * * * *